United States Patent [19]

Payne

[11] Patent Number: 4,639,716

[45] Date of Patent: Jan. 27, 1987

[54] ALARM PACKET SYSTEM

[75] Inventor: Earl R. Payne, Urbana, Ill.

[73] Assignee: ICI Americas Inc., Wilmington, Del.

[21] Appl. No.: 673,006

[22] Filed: Nov. 19, 1984

[51] Int. Cl.[4] ..... G08B 13/14

[52] U.S. Cl. ..... 340/571; 340/523; 340/568

[58] Field of Search ..... 340/571, 574, 568, 572, 340/539, 523, 561; 343/5 PD, 6.5 R, 6.5 SS, 6.8 R

[56] References Cited

U.S. PATENT DOCUMENTS

| | | | |
|---|---|---|---|
| 3,781,860 | 12/1973 | Freyling, Jr. | 340/571 X |
| 3,828,341 | 8/1974 | Carter, Jr. et al. | 340/571 |
| 3,938,125 | 2/1976 | Benassi | 340/572 |
| 4,319,332 | 3/1982 | Mehnert | 343/5 PD X |
| 4,410,884 | 10/1983 | Heiland | 340/523 X |
| 4,511,888 | 4/1985 | Bernhardt | 340/571 |
| 4,565,996 | 1/1986 | Close | 340/572 |

*Primary Examiner*—Glen R. Swann, III
*Assistant Examiner*—Thomas J. Mullen, Jr.
*Attorney, Agent, or Firm*—ALbert L. Free

[57] ABSTRACT

A system for actuating an alarm device secreted in a packet of bills when the packet is carried outwardly through a transmitted field at an exit from protected premises, in which such actuation is prevented when the packet is carried into the field near the exit and then back again into the protected premises. This is accomplished by constituting the field of two different field regions, an inner field region and an outer field region, having different identifying characteristics which are distinguishable by electronic circuitry in the packet, these field regions being disposed so that a person removing the packet from the protected premises must pass along an egress path extending in sequence through the inner field region and the outer field region. Circuitry in the packet produces signals indicative of when the packet is in one or the other of the two field regions, or in neither, and activates the alarm only when these signals indicate that the packet has been moved through the inner field region, and then through the outer field region to the exterior.

12 Claims, 20 Drawing Figures

$A = f_1 > TH, \quad C > TH$
$B = f_2 > TH, \quad C > TH$ $A = f_1 > f_2, \quad f_1 > f_3,$
$f_1 > TH$
$B_1 = f_2 > f_1, \quad f_2 > f_3,$
$f_2 > TH$
$B_2 = f_3 > f_1, \quad f_3 > f_2,$
$f_3 > TH$ $A = f_1 > f_2, \quad f_1 > TH$
$B = f_2 > f_1, \quad f_2 > TH$

ALARM PACKET SYSTEM

BACKGROUND OF THE INVENTION

This invention relates to alarm packet systems of the type in which a packet, such as a hollowed-out pack of real or bogus bills, contains a receiver, logic means and alarm actuating means for actuating an alarm device in the packet when the packet is exposed to a field near an exit from protected premises and is then moved away from the exit outwardly of the premises.

U.S. Pat. No. 3,828,341 of Carter et al, issued Aug. 6, 1974 describes and claims one form of such type of system which has been widely used commercially with success, especially in connection with banks which are subject to robbery. The bill packet containing the receiver is normally housed in a teller's drawer along with other bundles of genuine notes, and when cash is demanded by a robber the packet is given to him along with the genuine cash. Upon his leaving the premises, the robber passes through a field maintained at the exit, which arms the circuitry in the receiver in the packet of bogus bills; when he has gone outside and leaves the exit field, a timer is started by the receiver, and when the timer has counted-down, a suitable actuating means actuates what is generally termed an "alarm" within the packet, which may constitute an explosion releasing dye and/or tear gas.

While this system has proved highly successful for many purposes, it is subject to certain drawbacks. One of them is that it does not distinguish between carrying the packet into the exit field and then from the exit field to the exterior, and carrying the packet into the exit field and then back into the interior of the bank premises, out of the exit field. The latter path for the packet will generally result in actuating of the alarm within the bank premises, a condition which is considered highly undesirable. Also, should the packet be innocently moved about the protected premises by an authorized person for legitimate purposes, it may be inadvertently moved into the field and then out of the field so as to cause an undesired actuation of the alarm means. Furthermore, although in most cases the packet circuitry is disabled while it is in its storage position in the teller's drawer (as by an automatic disconnection of the supply battery from the circuitry), in other forms of the device, especially those using low current-drain circuitry, the battery may be continuously connected to the circuitry and the circuit therefore active at all times; in such case, should the field generated by the transmitting means at the exit momentarily expand to encompass the stored packet circuitry, e.g. during turning on of the transmitter, or due to a power surge or some other anomalous condition, then the circuitry will have been subjected to the field and then deprived of the field, a sequence which would initiate an undesired alarm at the cashier's storage location. The same would be true in an instance in which the packet is innocently removed from its normal storage location to be transferred to another and during the course of the move passes near to the protected doorway and therefore into and out of the exit field.

Accordingly, it is an object of the invention to provide a new and useful system of the type in which an alarm system contained in a packet is actuated when the packet is moved through an exit area suffused with a field to which a receiver in the packet is sensitive.

A further object is to provide such a method and system which causes actuation of the alarm system when the packet is moved through the exit and away from the exit on the exterior side thereof, but is not actuated if the packet is taken into the field at the exit and then moved back again into the protected premises.

Still another object is to provide such method and system in which actuation of the alarm in response to a presence and subsequent absence of a field is prevented so long as the packet is on the inner side of the exit, toward the protected premises.

It is also an object to provide such a system in which the alarm in the alarm packet is activated only if the packet is moved from within the protected premises along an egress path extending through an exitway to the exterior of the protected premises.

A still further object is to provide such a system which is relatively simple, economical and reliable, and utilizes a receiver, an alarm-actuating circuit and an alarm means which readily fit within the interior of a packet of bills of government currency.

SUMMARY OF THE INVENTION

These and other objects of the invention are achieved by the provision of a system in which a plurality of mutually-exclusive field regions having respectively different field characteristics are provided, each of which extends across the path taken by a packet when it is moved through an exit from a first position on one side of the exit to a second position on the other side of the exit, said packet encountering said field characteristics in a predetermined first sequence when it is moved through said exit from said first position to said second position and in a predetermined second sequence differing from said first sequence when it is moved through said exit from said second position to said first position; field-sensing means are provided in said packet which are responsive to these field characteristics to produce signals indicative of the field region in which the packet is located at any time during its movement along said path, and circuit means are also provided in said packet which respond to said signals to activate an alarm circuit only when said packet has been moved through said exit from said first position to said second position, and not when it is moved through the fields in the opposite direction from said second position to said first position, or from said first position into said field regions and then back again to said first position.

Preferably the arrangement of fields is such that the sequence of field characteristics which said packet encounters in moving from any position in one of said field regions to said second position is different from any sequence which it encounters in moving from said any position toward said first position, whereby the circuit means in said packet do not activate the alarm when the packet is taken from its first position into said field regions and then returned either completely or part way toward said first position.

Preferably two such mutually-exclusive different field regions are used, and the circuit means operate to activate the alarm when the field-sensing means senses that the packet has moved from a predetermined first of said two field regions into the second of said two regions and then out of said second region other than by returning into the first of said regions. In a preferred embodiment, both field regions contain alternating magnetic flux fields of two different frequencies $f_1$ and $f_2$, and the identifying characteristic of the first field region is that the alternating magnetic flux field of frequency $f_1$ therein has a scalar magnitude greater than that of the magnetic flux field of frequency $f_2$ therein, and the sum of the squares of the scalar magnitudes of the magnetic flux fields at frequencies $f_1$ and $f_2$ is greater than a threshold value; the preferred identifying characteristic of the second field region is that the alternating magnetic flux field of frequency $f_2$ therein has a scalar magnitude greater than that of the magnetic flux field of frequency $f_1$ therein, and the sum of the squares of the scalar magnitudes of the magnetic flux fields at frequencies $f_1$ and $f_2$ is greater than a predetermined threshold value.

In combination with this field system there is used a receiver, carried in the bill packet, which detects the above-mentioned identifying field characteristics. The receiver responds to these identifying characteristics to produce corresponding signals indicative of whether the packet is in the first, inner field region or in the second, outer field region, or outside the boundary of both field regions. Also included in the packet are an alarm means, an alarm-actuating means, and logic means responsive to signals produced by the receiver for operating the alarm-actuating means after the packet has been removed outwardly through the exit beyond the boundary of the two field regions. Preferably the logic means is such that the alarm means is operated only when the packet has been moved in sequence through the first or inner field region, through the second or outer field region and across its outer boundary, and then remains beyond said boundary for a predetermined minimum time.

In the preferred embodiment the packet contains a receiver capable of producing signals representative of the sum of the squares of the scalar magnitudes of the two frequency components of the transmitted signals at the packet, and of the difference between the squares of the scalar magnitudes of the two frequency components. In response to these signals, the receiver produces a signal indicative of whether or not the sum of the squares of the two scalar magnitudes exceeds a predetermined threshold value, and another signal indicative of whether or not the scalar magnitude of the frequency component at frequency $f_2$ exceeds the scalar magnitude of the frequency component at frequency $f_1$ (if $f_2^2$ equals $f_1^2$, then $f_2=f_1$). From these signals, the logic circuit operates the alarm-actuating circuit only when the following sequence occurs: the field at the packet is above the threshold value and the scalar magnitude of the $f_1$ component is not less than that of the component at $f_2$; then, the field is still above threshold value and the scalar magnitude of the $f_2$ component exceeds that of the $f_1$ component; and then, while the $f_2$ scalar magnitude exceeds the $f_1$ scalar magnitude, the sum of the scalar magnitudes of the $f_1$ and $f_2$ signals falls below said threshold value. If the latter condition persists for a time longer than the count-down period of the firing timer, then the alarm is operated. Preferably the logic is such that if, before the alarm means is operated, the packet is carried back and forth, in and out of the various field regions, it will still function to effect the desired firing after it is finally removed outwardly beyond the outer field boundary for a period sufficient to permit count-down of the firing timer.

Thus, in a preferred form of the invention, should the packet be returned into the inner or outer field region before the alarm fires, then the timer will be reset and inhibited so as to prevent actual operation of the alarm until the packet is again removed from the outer field region, on the side thereof exterior to the exit, long enough for the timer to count-down. Of course, if the packet is moved from the first or inner field region farther into the protected premises, the timer will not be started nor the alarm actuated even though the sum of the squares of the scalar magnitudes of the $f_1$ and $f_2$ field components at the packet decreases below its threshold level, since the receiver then senses that the packet was in the first, or inner, field region just prior to this decrease and therefore does not initiate alarm operation.

Accordingly, if the packet is brought from outside the protected premises, through the field regions to the interior of the protected premises, the alarm will not be activated. Likewise, if the packet is brought from inside the protected premises into the first or inner field region and then returned to the interior of the premises the alarm will not be activated. Should the packet be taken from the interior of the premises through the first region, into the second region and then return whence it came, the alarm will not be activated. Furthermore, should the packet be taken through the first region, then through the second region to the exterior of the premises, and then returned to within the composite field boundary before the predetermined time and subsequently returned to the interior of the premises, it will not produce activation of the alarm. In each of the above sequences of events the alarm is not activated because the sequence of events is not that single sequence which is essential for activation.

One preferred arrangement for providing the above-described type of composite field having frequency components $f_1$ and $f_2$ is to locate a transmitter of signals of frequency $f_2$ somewhat toward the exterior of the protected premises with respect to the position of the transmitter of the frequency $f_1$. Also, to separately determine the relative scalar magnitudes of the frequency components of frequencies $f_1$ and $f_2$, there is preferably (but not necessarily) employed the field-measuring circuitry described and claimed in copending application Ser. No. 673,007 of Earl Payne, filed of even date herewith, which accomplishes the desired sensing, measurement and comparison functions in an especially simple, inexpensive and reliable manner.

BRIEF DESCRIPTION OF FIGURES

Other objects and features of the invention will be more easily understood from the following detailed description of preferred embodiments, taken with the accompanying drawings, in which.

DETAILED DESCRIPTION OF THE PREFERRED EMBODIMENTS

Figure 1:
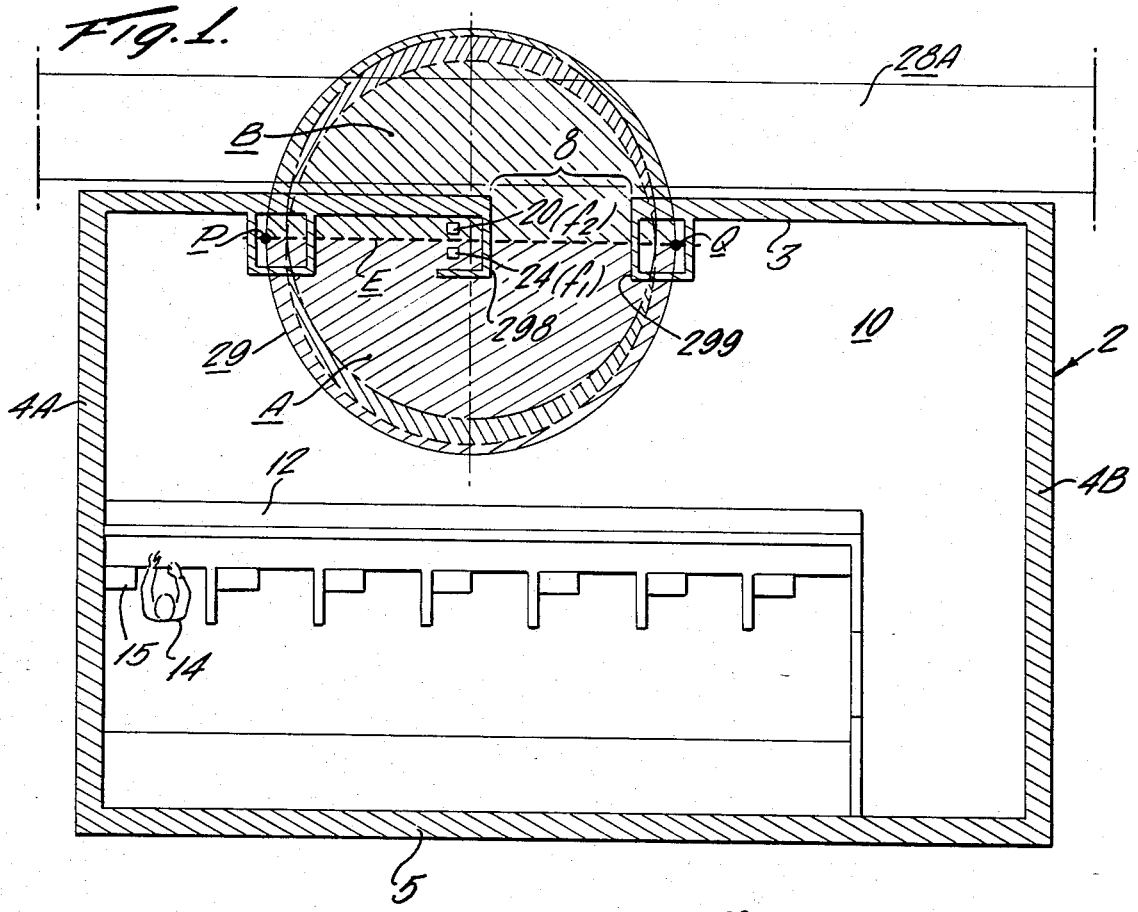
FIG. 1 is a schematic plan view showing a typical installation of a preferred form of the invention.

Referring to FIG. 1, there are shown protected bank premises 2 enclosed by front, side and rear walls 3, 4A, 4B and 5, with a doorway 8 in the front wall serving as an entrance to and exit from the bank lobby 10, for traversal by customers and the like. Behind the tellers' counter 12 are shown individual tellers' locations such as 14 each adjacent a cash storage drawer such as 15, where cash and the bill packets described hereinafter are typically stored.

Adjacent the doorway or exit opening 8 are positioned two magnetic flux transmitters 20 and 24 transmitting at frequencies $f_2$ and $f_1$, respectively. The boundary of the combined fields within which the sum of the squares of the scalar magnitudes of the two frequency components at $f_1$ and $f_2$ exceeds a predetermined threshold level is shown schematically by the solid line 29, which circumscribes the exit opening 8, so that the combined field encompassed within line 29 bridges the latter exit opening. The two transmitters are located and powered so that, forward (or on the outer side) of the demarcation line E (that is, in an outer field region designated as region B) the scalar magnitude of the field component of frequency $f_2$ exceeds the scalar magnitude of the field component at frequency $f_1$, while in an inner field region A, on the inner or protected-premise side of the demarcation line E, the opposite is true, i.e. the scalar magnitude of the frequency component of the field at frequency $f_1$ is not less than that at frequency $f_2$. Along the demarcation line E the scalar magnitudes of the two frequency components are the same, and the latter line also bridges the exit opening 8. It will be understood that line E represents a section through an approximately vertical surface which divides regions A and B from each other, regions A and B extending perpendicular to the paper in FIG. 1 so that each occupies a three-dimensional, somewhat ellipsoidal volume in space.

Accordingly, for a robber carrying a bill packet to leave the protected premises and escape, it will be necessary for him to move along an egress path extending from a region near the teller's counter which is substantially free of both field components (i.e. the scalar magnitude of the sum of the squares of the two field components is less than a threshold value), across the boundary line 29 and into the first field region A wherein the field component at frequency $f_1$ dominates, then across the demarcation line or surface E, into and through the second field region B in which the field component at frequency $f_2$ dominates, and then outward across the field boundary line 29 where the sum of the squares of the scalar magnitudes of the $f_1$ and $f_2$ components becomes less than the selected threshold value, to the public way 28A where the robber would normally continue his escape.

Figure 2:
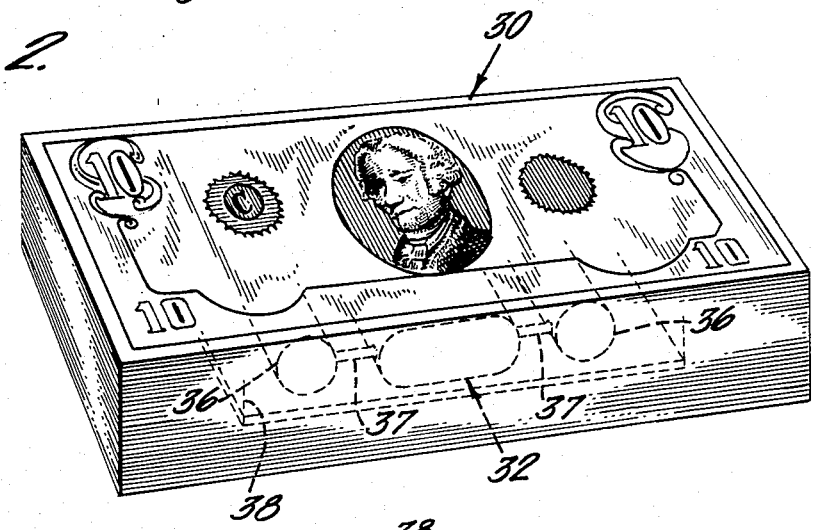
FIG. 2 is a perspective view of an alarm packet suitable for use in the invention.
Figure 2A:
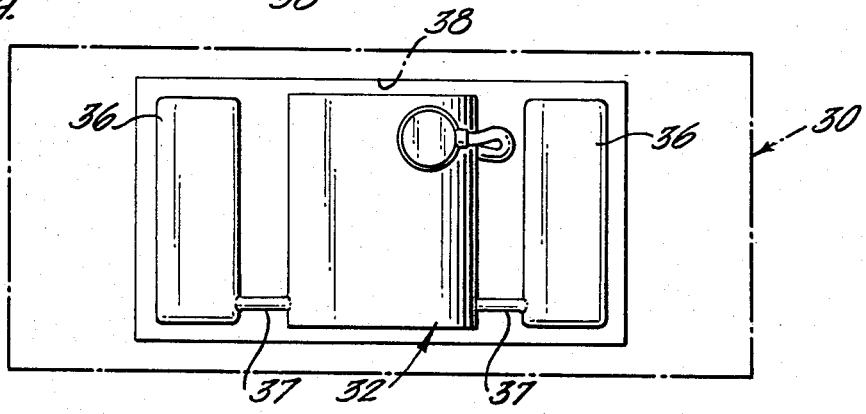
FIG. 2A is a schematic sectional view of the packet of FIG. 2, showing a preferred general location for major components of the electronic portions of the packet.

FIGS. 2 and 2A illustrate schematically a typical bill packet 30 having a cavity therein containing electrical circuitry 32 comprising the field-sensing receiver means, logic circuitry and alarm-operating circuitry, and alarm means 36 consisting of a pair of electrically operated smoke generators which produce colored smoke and, optionally, tear gas, and which are electrically connected to the alarm-operating circuitry by appropriate leads such as 37. The circuitry employed may be partially analog and partially digital, and may use custom-made integrated-circuits and thick-film hybrid technology to achieve the desired functions within the limited space in cavity 38.

Figure 3:
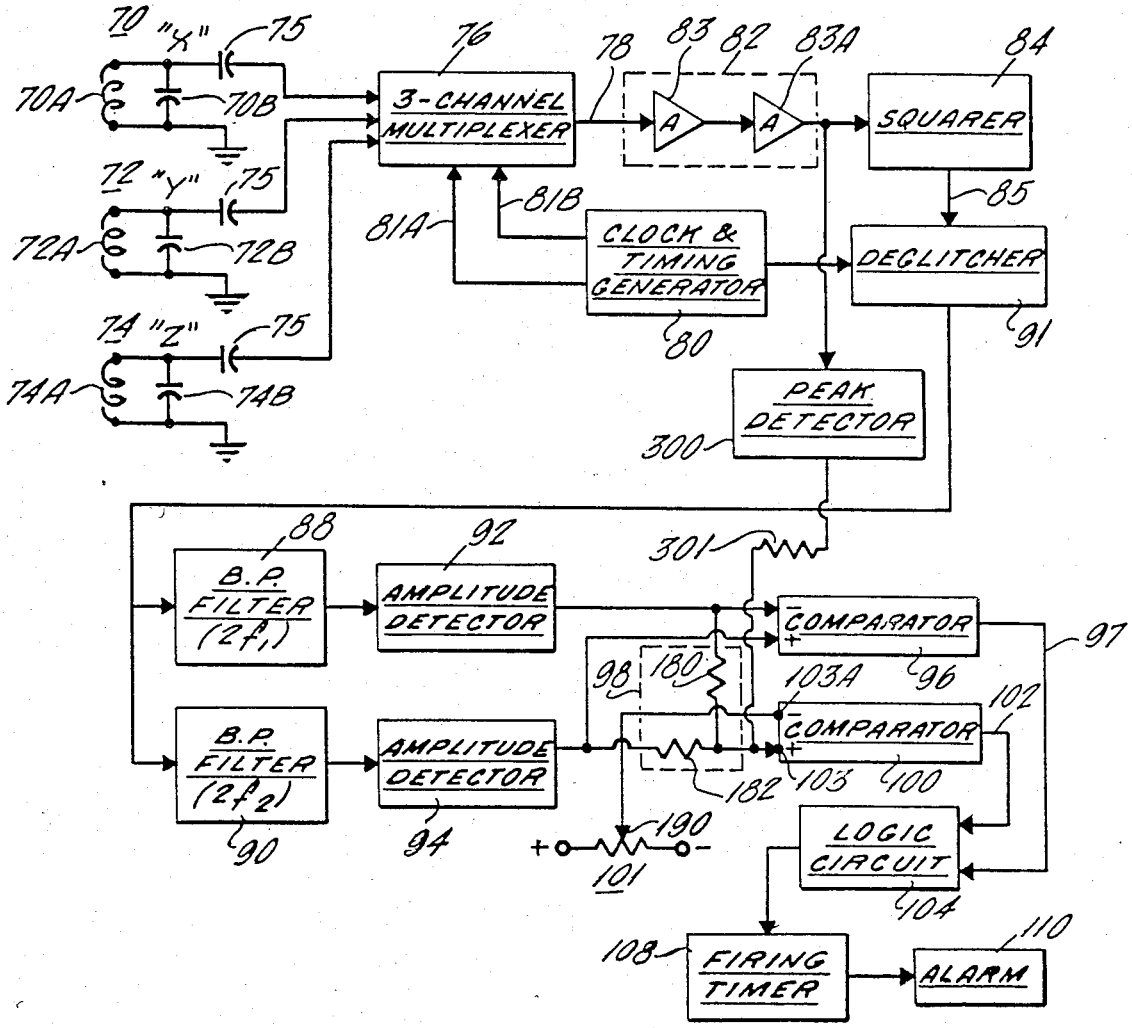
FIG. 3 is a block diagram of a preferred embodiment of electronic circuitry for use in the alarm packet.

FIG. 3 illustrates the preferred electronic circuitry for use in the packet. Directional x, y and z field-sensors 70, 72, 74, preferably in the form of three small mutually-orthogonally oriented cylindrical sensing coils, 70A, 72A and 74A tuned by respective parallel capacitors 70B, 72B and 74B, are positioned on a supporting chassis within the packet and adjacent each other so as to sense, and to produce electrical currents respectively proportional to, the sum of the x-directed directional components of the field components at frequencies $f_1$ and $f_2$, the sum of the y-directed directional components of the field components at frequencies $f_1$ and $f_2$, and the sum of the z-directed directional components of the field components at frequencies $f_1$ and $f_2$, at the position of the packet. A three-phase sampler or multiplexer 76 is connected to sample, sequentially and repetitively, the directional-component signals in the three sensing coils. The multiplexer is arranged to select each of the three coils for one third of the time and to have a sampling frequency substantially higher than either frequency $f_1$ or $f_2$, viz, at least four and preferably six times the highest frequency to be sampled.

As described in more detail in the above-cited copending application, the operation of the multiplexer is controlled by the clock and timing generator 80 over lines 81A and 81B, so as to sample the output signals of the three sensing coils at equal time-spaced intervals, each output being sampled, as an example, at a rate of about 5461.33 Hz.

Accordingly, on the output line 78 of the sampler 76 there are produced interleaved samples of the sums of the two field components. The latter signals are passed through a wideband amplifier 82 to a squarer 84, which operates to produce on its output line 85 a series of signal samples corresponding to those at its input, but having amplitudes which are substantially proportional to the squares of the amplitudes of the corresponding samples at its input. Preferably a deglitcher or resampler 91 operates to select only the signals present in the latter halves of the sampled pulses, so as to delete undesired switching transients from the multiplexer, the timing of the deglitcher being controlled from the same clock and timing generator 80 which is used to control the sampling by the multiplexer 76. The output of the deglitcher then contains, among other frequency components, the second harmonics of the two frequencies $f_1$ and $f_2$.

For the reasons set forth in detail in the above-cited copending application, the amplitudes of these second harmonic components of frequencies $2f_1$ and $2f_2$ are proportional to the squares of the scalar magnitudes of the field components at frequencies $f_1$ and $f_2$, respectively, at the sensing coils of the packet. Accordingly, the signal from the deglitcher is applied to a first bandpass filter 88 which selects the second harmonic at frequency $2f_1$, and also to a second bandpass filter 90 which selects the second harmonic component at frequency $2f_2$. These two second-harmonic components are then applied to the amplitude detectors 92 and 94 respectively, which produce respective output signals proportional to the squares of the amplitudes of the two second harmonic components. The two detected signals are supplied to two inputs of the comparator 96, which produces an output HIGH signal on line 97 only when the detected signal produced by frequency component $f_2$ exceeds the magnitude of the detected signal produced by frequency component $f_1$.

Also shown in this embodiment is an adder circuit 98 comprising resistors 180 and 182 which serve to add the outputs from the two detectors 92 and 94 and to supply this sum to one input terminal of comparator 100; the other input terminal of comparator 100 is supplied with a threshold bias from adjustable supply source 101, so that comparator 100 produces a HIGH at its output lead 102 only when the sum of the signals at its input terminal 103 is at least as great as the bias applied to its input terminal 103A; the bias voltage is preferably adjusted so that the threshold which it produces corresponds to the threshold level at the field boundary 29 of FIG. 1.

Accordingly, the output of comparator 96 has two states, a HIGH state (BG for "B greater") indicating that the field frequency component at frequency $f_2$ exceeds the field frequency component of frequency $f_1$ and hence that the packet is in field region B, and a LOW state ($\overline{BG}$) indicating that the packet is in a field region where the component at frequency $f_2$ is not greater than that at $f_1$. The output of comparator 100 has two output states, a HIGH output (SP, for "signal present") indicating that the packet is within the boundary 29 where the strength of the total field is greater than the predetermined threshold value, and a LOW state ($\overline{SP}$) indicating that this is not the case. The outputs of the two comparators are supplied to a logic circuit 104 which determines when the packet is removed outwardly from the composite field region beyond the boundary 29 and, at such times, initiates the count-down of a firing timer 108 which, when it counts down, actuates the alarm 110, for example to release colored smoke. Since it is only when the packet is thus carried outward across the boundary 29 that the previously-described logic conditions occur, the starting of the count-down of the timer will only occur when the robber carrying the packet has passed outwardly through the exit and through the adjacent field to a remote position beyond the field boundary where the sum of the squares of the scalar magnitudes of the $f_1$ and $f_2$ fields drops below its selected threshold value.

Should the robber carry the packet from the teller's location into field region A and then back again out of field region A and across the boundary 29 on the inner side of the exit, the firing timer will not be started, because although the output of comparator 100 will be HIGH while the packet is in the field region A and will go LOW when the packet is moved across the boundary 29 further into the protected premises, the output of comparator 96 will be LOW, rather than HIGH, at that time because the scalar magnitude of the field component at $f_2$ is at such time not greater than that of the field component at $f_1$.

Further, as described in issued U.S. Pat. No. 3,828,341, should a robber who has left the premises (so that the firing timer has started) change his mind and, before the timer times out, return to the exit field, as soon as he does so the logic circuit will sense that the composite field at the packet has increased from below to above the threshold level and that the robber is now within the boundary 29, and will therefore terminate the counting of the timer and reset it to zero until such time as the packet may again be removed outwardly from the field region B. This prevents the alarm from being actuated near the exit or inside the premises, which would be undesirable for obvious reasons.

There are other features which may also be incorporated in such a bogus packet to advantage in certain circumstances, but the particular use or non-use of such special features depends upon the desires of the purchaser, the exigencies of the particular application and the cost involved. Accordingly, there has not been shown in detail how the battery is normally connected to the circuitry; as in issued U.S. Pat. No. 3,828,341, the battery may normally be disconnected from the circuitry to render the circuitry inoperative, by means of a magnetically-opened reed switch, when the packet is in its normal storage position in the cashiers' drawer, the reed switch being closed by a spring when the package is removed from the magnetic plate so as to supply operating voltage to the circuit when it is taken out of the drawer to hand to a robber, for example.

It is also possible to utilize a battery which is permanently connected to a part of the circuitry which draws little current, and which senses (for example by detecting capacitance changes) when the packet has been removed from its normal storage space to connect the battery also to portions of the circuit which require larger currents, thus properly rendering the circuitry fully effective upon removal of the alarm packet from its normal storage space but reducing the amount of current required during ordinary storage.

The details of the preferred packet circuitry are as described in my above-cited copending application, and need not be repeated herein. As described in that application, one preferred set of values for the transmitted frequencies is $f_1=812.5$ and $f_2=1187.5$ Hz. These are desirable, first because they are both at very low frequencies where magnetic induction field lines are able to penetrate even metal casings of appreciable thickness into which the robber may have placed the packet, and because they are not as subject to shadowing or blocking by bodies or other packages which may be present while the packet is carried through the exit as is the case when radio-frequency fields are employed. This particular relationship between the two frequencies is especially suitable since the individual frequencies themselves are not simple multiples of the 60-cycle line frequency, the two frequencies are not related to each other in any simple harmonic relationship or by any simple fractional relationships, and the sums and differences of the two frequencies are sufficiently different from the harmonic frequencies $2f_1$ and $2f_2$ to permit practical selection of the second-harmonic frequency components from among the other components generated during the procedure, as described fully in the above-cited copending application.

As also described in my above-cited copending application, the sensing coils 70A, 72A, 74A may be small cylindrical coils with their axes at right angles to each other; the multiplexer 76, the clock and timing generator 80, the amplifier 82 and the deglitcher 91 may all be implemented with standard components, but in this preferred embodiment wherein space and current demand must be minimized, they are preferably embodied in semi-custom integrated chips. The bandpass filters 88 and 90 may be active filters of known types providing, in effect, about a 10% bandwidth centered about the frequency which they are to select. The detectors 92 and 94 may each comprise a fullwave rectifier followed by a lowpass filter having a passband of about 0–10 Hz which averages the full-wave rectified signal to produce the desired DC signals varying in accordance with the squares of the scalar magnitude of the field component of the corresponding frequency. As discussed in the above-cited copending application, one can follow the detectors with square-rooter circuits of one kind or another to produce output signals which actually vary as the scalar magnitude of the particular frequency component, rather than as a square of that component, but for the present purposes this is not necessary.

The comparators 96 and 100 are preferably good quality operational amplifiers to provide the fine discrimination and low hysteresis required for accurate definition of the field boundaries. The logic circuits are preferably embodied on integrated-circuit chips in order to decrease their size and expense. The firing timer of conventional design is preferably incorporated with the other logic circuits on an integrated circuit chip, and the alarm device may be standard and such as has been used for years in similar commercial devices. As mentioned above, the supply battery can be disconnected when in the teller's drawer by a magnet which holds open a reed relay switch, and reconnected automatically as the packet leaves the field of the magnet, or permanently connected only to that part of the circuitry which detects capacity changes when the pack is lifted from the drawer by a hand and which then provides power to the rest of the circuitry, for a time which is limited unless other fields are detected. It is also possible, but not necessary, to include within the packet an RF transmitting circuit which, when the packet is removed from its normal storage location, will be activated to radiate by means of radiowaves, to a remote receiver, a signal indicating that the pack has been removed, and also to radiate data indicating the location from which it was removed. These various optional features not being part of the present invention, they have not been shown and described in detail, in the interest of clarity.

Figure 4A:
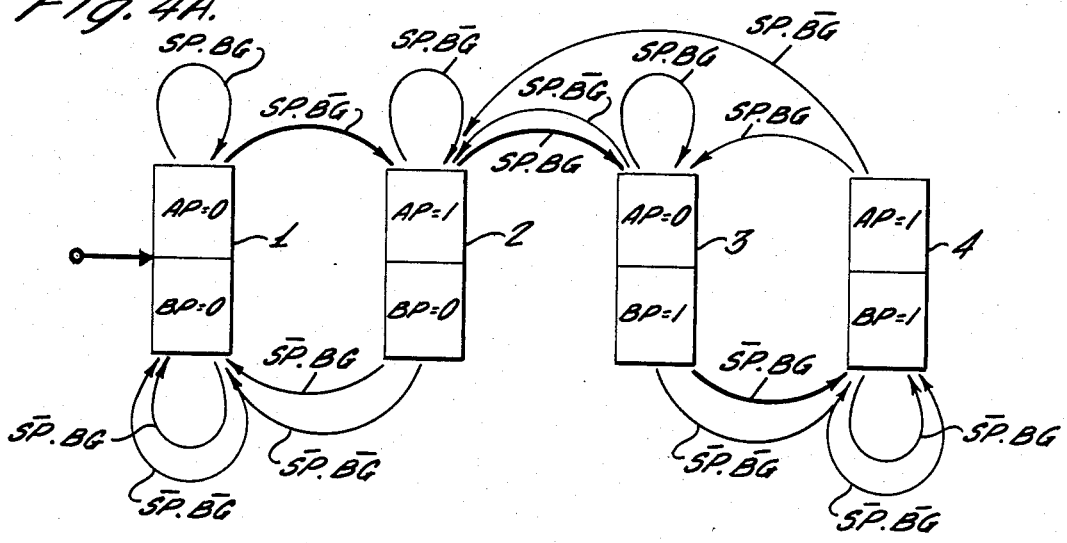
FIG. 4A is a transition diagram illustrating the operation and functions of the logic circuit of FIG. 4.
Figure 4:
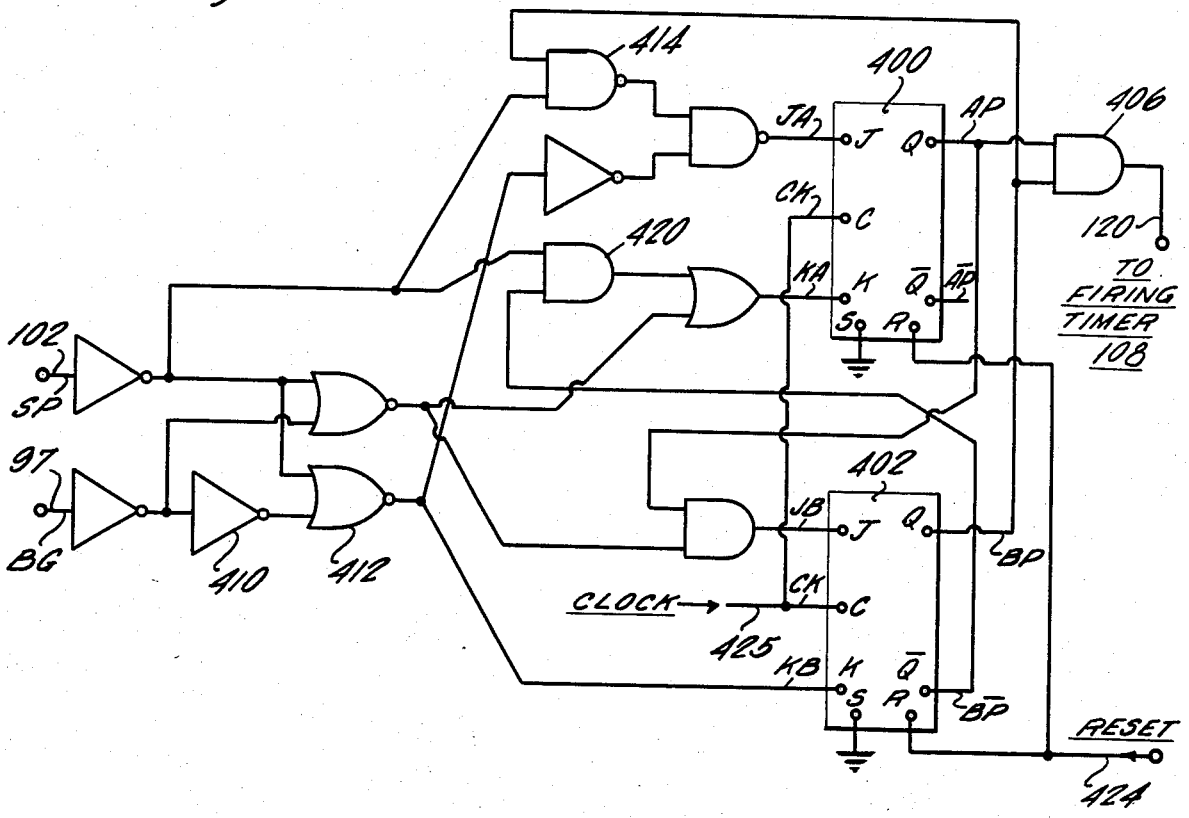
FIG. 4 is a schematic diagram of a preferred form of logic circuit for use in the invention.

FIG. 4 shows schematically one form of logic circuit which is suitable for use in the present system, although many other types of logic circuit and implementation are feasible. It is supplied over lead 97 with the output of comparator 96, which in this example goes HIGH each time the scalar magnitude of the field component at frequency $f_2$ exceeds the scalar magnitude of the component at frequency $f_1$. It is also supplied over lead 102 with a signal indicating whether the sum of the scalar magnitudes of the two frequency components exceeds a predetermined threshold value corresponding to the boundary line 29 in FIG. 1.

For the present purposes a HIGH (1) on line 102 indicates the signal-present condition (SP), indicative of the fact that the sum of the squares of the scalar magnitudes of the two field components at the packet is greater than its predetermined threshold level, while the opposite condition, namely that the total of the scalar magnitudes of the two field components at the packet is not above the threshold level, is designated as $\overline{SP}$. Similarly, a HIGH on line 97 is designated by the symbol BG, indicating the existence of the condition for which the scalar magnitude of the $f_2$ field component is greater than the scalar magnitude of the $f_1$ field component at the pack; the opposite condition in which the $f_2$ field component is not greater than the $f_1$ field component is indicated by the symbol $\overline{BG}$. Output line 120 of the circuit of FIG. 4 leads to and controls the activation of the firing timer 108 to start the count-down to operation of the alarm 110.

Details of the function of the circuit of FIG. 4 will be more readily understood from the following description of the transition diagram of FIG. 4A and the truth table of Table I.

In FIG. 4A the four rectangles labelled 1, 2, 3 and 4 represent the four possible combinations of states of the digital signals at the output terminals AP and BP of the same pair of bistable devices 400 and 402 of FIG. 4. As indicated by the legends in FIG. 4A, in state 1 AP=0, BP=0; in state 2, AP=1, BP=0; in state 3, AP=0, BP=1; and in state 4 AP=1, BP=1. State 1 represents the state of the bistable devices which exists after the power has been turned ON and the devices initialized, by the temporary excursion of the signal on the reset line 424 into the higher or 1 state. This "power-on" reset action can be achieved by conventional means or as a function performed by part of the capacity detector circuits responsible for controlling power flow to the logic circuit to FIG. 4. Referring to FIG. 4, immediately after initialization and before any clock pulse appears on line 425, the output state AP=0, BP=0 at the Q terminals of bistable devices 400 and 402 is present at the corresponding inputs of the AND gate 406. Until a sequence of events occurs, as will be described below, which causes both inputs to AND gate 406 to be high, i.e. AP=1, BP=1, no activation of the firing timer will occur.

In the state transition diagram of FIG. 4A the arrows indicate the changes of state when a clock pulse is applied to the circuit of FIG. 4. Thus, for example, the curved arrow labelled SP.BG at the top of the state 1 diagram indicates that so long as the condition SP.BG (signal present, $f_2$ field component stronger than the $f_1$ field component) persists, each subsequent clock pulse will leave the bistable devices in the same state 1 condition (0,0). The curved arrows below the state 1 diagram indicate that if the inputs to the circuit for any reason change to $\overline{SP}$.BG or $\overline{SP}.\overline{BG}$, upon the occurrence of the next clock pulse the two bistable devices will still remain in their state 1 condition (0,0). The only input condition which will move the bistable devices from state 1 to state 2 (AP=1, BP=0) is that indicated by the heavy arrow extending from the top of the state 1 diagram to the top of the state 2 diagram, namely the input condition SP.$\overline{BG}$. The latter input condition means that the sum of the $f_1^2$ and $f_2^2$ signals has risen above the threshold level (SP) but that the $f_2$ field component is not greater ($\overline{BG}$) than the $f_1$ field component. This is the change in condition which normally occurs when the initialized packet is taken from its storage position at the teller's location into the indoor A field region adjacent the inner side of the exit. Thus when the input to the circuit of FIG. 4 changes to SP.$\overline{BG}$, and a clock pulse subsequently occurs, the bistable devices will change to the 1,0 condition of state 2 of FIG. 4A. The frequency of occurrence of the clock pulses is not critical so long as they occur frequently enough to ensure that the logic can keep track of the movement of the packet through the composite field. A frequency of 32 Hz is adequate in this application.

Again, having reached the state 2, there are four possible combinations of SP and BG which can thereafter occur. The arrow directly above the state 2 diagram indicates that so long as the input condition SP.$\overline{BG}$ persists, subsequent clock pulses will leave the bistable devices in state 2 (1,0); the two arrows leading from the bottom of the state 2 diagram back to the state 1 diagram and labelled $\overline{SP}$.BG and $\overline{SP}.\overline{BG}$ indicate that if the sum of the scalar magnitudes of the $f_1$ and $f_2$ fields disappears, i.e. falls below the threshold level, the bistable devices will return to state 1 (0,0). Accordingly, if one carries the packet into the indoor A field and then back again into a location near the teller where there is no substantial field, the bistable devices will return to state 1 (0,0); now, should the packet be moved again into the A field region, the system will shift again from the state 1 to the state 2 condition, and this transition back and forth between states 1 and 2 will repeat no matter how many times the packet may move back and forth across the boundary 29 between the inner A field region and the indoor region where there is no substantial field.

A transition of the bistable devices to their state 3 occurs, as again shown by the heavy arrow, when the bistable devices are in state 2, the inputs change to SP.BG, and a clock pulse then occurs. SP.BG represents the condition of "combined field present" and "$f_2$ field component predominant", as is characteristic of the outer field region B.

Having reached state 3, so long as the input conditions remain SP.BG, subsequent clock pulses will leave the bistable devices in state 3, as indicated by the curved arrow above the state 3 diagram. Should the input signals change to SP.$\overline{BG}$, as will occur if the packet is moved back from the outdoor field B to the indoor field A, the bistable devices will revert to state 2 (1,0), and if the packet is carried back and forth between the inner and outer fields A and B the state of the bistable devices will change correspondingly between the 1,0 and the 0,1 states. To get to state No. 4, namely the 1,1 condition of the bistable devices, one must first reach state 3 and then the combined field strength must disappear, i.e. the sum of the squares of the scalar magnitudes of the $f_1$ and $f_2$ components must fall below the designated threshold level, as indicated by an input signal $\overline{SP}$.BG or $\overline{SPBG}$. In the normal operation of the presently described apparatus, the $\overline{SP}$.BG condition will occur when the packet is removed from the outdoor field region and away from the exit, as is indicated by the heavy arrow.

When in state 4, subsequent clock pulses occurring while the $\overline{SP}$.BG or $\overline{SP}.\overline{BG}$ conditions persist will leave the bistable devices in state 4, while a shift of the input conditions to SP.BG followed by a clock pulse will cause the bistable state to revert to state 3 (0,1) and a shift of the input signal conditions to SP.$\overline{BG}$ will cause a reversion to state 2 (1,0). A change to the SP.BG conditions will be produced if the packet is carried from a position remote from the outer side of outdoor field B back into the indoor field A; the system permits the bistable devices then to move back again to state 4 if the packet is again carried outwards away from the outdoor field B. The reversion from state 4 to state 2 upon the occurrence of an input signal SP.$\overline{BG}$ may occur if the packet is carried outside the outdoor field and then somehow carried back around the B field and into the A field without having recrossed the B field, a condition which is unlikely to occur in normal operation.

From FIG. 4A it will then be appreciated that it is the achievement of the state 4 (1,1) in the bistable devices which actuates the firing timer for the explosive in the packet. Thus, referring to FIG. 4, it is only when the AP and BP inputs to AND gate 406 are both 1 that a signal passes through the AND gate to start the time-out of the firing timer 108 of FIG. 3. FIG. 4A illustrates the progression normally required for this to occur; state 1 is achieved when the operating power is applied to the pack; state 2 is achieved when the sum of the squares of the scalar magnitudes of the $f_1$ and $f_2$ field components is above the threshold and the field component of frequency $F_1$ predominates; the transition from state 2 to state 3 occurs only when the sum of the squares of the scalar magnitudes of the $f_1$ and $f_2$ components is above the threshold and the $f_2$ field component predominates; and state 4 is achieved from state 3 when the sum of the squares of the scalar magnitudes falls below the threshold. The system will operate properly if one carries the pack moves back and forth in the various zones but ultimately leaves the exit in the usual way but, as desired, will not operate to produce firing if a fresh, initialized packet is carried from an outdoor position remote from the exit inwardly through the exit. It is noted that all combinations of the two input signals and of the output bistable devices are provided for in the transition diagram, so that there is little likelihood that random electrical noise or other anomalous occurrences will cause false firing of the explosive in the pack.

Table I hereof is a truth table corresponding to FIGS. 4 and 4A. This table assumes the use of J-K flip-flops as the two bistable devices 400,402, which flip-flops have the following logical properties when clocked: if the J and K inputs to the flip-flop are different from each other upon the occurrence of a clock pulse at its clock pulse input terminal, the Q and $\overline{Q}$ outputs of the device will assume the same values as the J and K inputs, respectively; when the J and K inputs are both zero upon the occurrence of a clock pulse, there is no response and the output states remain the same as previously. If the J and K inputs are both 1's, the flip-flop toggles to the opposite state, but this toggle action is not used in the present device.

In Table I, under "System State" there are shown all the possible combinations of values of the SP, BG, AP and BP signals, of which there are sixteen. Under the headings "AP Inputs" and "BP Inputs" there are shown the JA, KA, JB and KB input signals to the bistable devices 400 and 402 corresponding to each of the sixteen system states. The right-hand column headed "Result of Clock" shows the values of AP and BP produced in response to a clock pulse occurring when the other system conditions shown on the same horizontal line of the table exist. Thus each horizontal row in Table I corresponds to one of the transition lines of FIG. 4A. For example, considering the last row in Table I, this shows that if AP=1, BP=1 (state 4 of bistable devices) and the input signal to the logic circuit becomes SP=1, BG=1, then the signal at JA will be 0, that at KA will be 1, that at BP will be 1, and that at KB will be 0, and upon the occurrence of the next clock pulse, AP will become 0 and BP will become 1. This represents what will happen if the packet is taken outward from the outer field region B so that the timer begins to operate (State 4) but, before the explosives are detonated, the packet is moved back into the outer field region B (State 3) and the timer therefore stopped and reset.

Similarly, the transition from state 1 to state 2 is shown by row 9 in Table I, that from state 2 to state 3 is shown by row 15, and that from state 3 to state 4 is shown by row 6.

The relationships described in the transition diagram and in the truth table can be provided by any of a large variety of digital circuitry or, for example, by means of a suitably programmed microprocessor, using techniques within the skill of the art. FIG. 4 illustrates one preferred type of digital circuit which can be employed for this purpose. In this diagram the symbols such as that at 410 represent inverter amplifiers, the symbols such as that at 412 represent NOR gates, the symbols such as that at 414 represent NAND gates and the symbols such as 406 and 420 represent AND gates. It is understood that clock pulses from the logic circuit are applied over line 425 to the CK input terminals of the JK bistable devices, and a reset signal is applied over line 424 to the reset terminals of the two bistable devices to reset them automatically when they are first removed from the cashier location. The interconnections of the digital devices being shown in detail in FIG. 4, and their functions and operation being shown and described in detail with reference to FIGS. 4A and Table I, it will not be necessary to describe FIG. 4 in further detail.

It is noted that the states listed in Table I under JA and KA are the inverse of each other, and the information is to this extent redundant; by taking advantage of this fact, one could by conventional design eliminate, for example, the JA logic and thus achieve a simpler implementation.

While the system as thus far described is generally operative for its intended purposes, two possible sources of occasional false firing of the alarm device have been recognized. One is that the transmitted power is typically sufficiently great at some position near the transmitter, and the receiver sufficiently sensitive, that if the packet is carried into such a position the circuitry in the packet may be strongly overloaded by the resultant excessively high signal levels produced within it, so that the signals out of the two amplitude detectors no longer properly represent the scalar magnitudes of the $f_1$ and $f_2$ components, and typically may both become nearly zero. Since the packet, prior to the overloading, is typically in the B field region, loss of signal tells the logic circuit that the packet has now been moved outward from the B region and beyond the boundary 29 of the combined $f_1$ and $f_2$ field, and that the firing timer is to be started. This possibility of false actuation of the firing timer is preferably avoided by the use of a threshold type peak-detector 300 of conventional form, supplied with the output of the amplifier 82 and responsive to it, to supply the input terminal 103 of comparator 100 with a large signal through resistor 301 whenever the output of amplifier 82 increases to the overload level. The peak detector may include a bias circuit or a semiconductor threshold device such that the peak detector produces no output when the output of amplifier 82 is in the normal range and produces a substantial output only when the output of amplifier 82 exceeds a predetermined overload level. With this arrangement, upon the occurrence of overload the output of comparator 100 is held HIGH, indicating the SP state and preventing the logic circuit from starting the firing timer. When the packet is subsequently moved on, away from the transmitter, the overload condition disappears, as does the output of the peak detector, and normal operation resumes. The circuit therefore operates, when needed, to prevent premature firing of the alarm device due to circuit overload in the packet.

A second possible source of occasional false or premature firing is excessive electrical noise at the packet. This may occur due to operation of an electric motor near the packet, for example, which can produce substantial random outputs from both of the $2f_1$ and $2f_2$ filters 88 and 90. This can result in a signal-present HIGH at the output of comparator 100, and an $f_2$-field-component-not-dominant signal ($\overline{BG}$) followed by an $f_2$-field-component-dominant (BG) signal from comparator 96; this sequence, followed by termination of the noise signal, produces the ($\overline{SP}$,$\overline{BG}$) condition, and can produce premature firing when the packet is near the teller's location, outside of the inner field region A, for example; it can also interfere in other ways with the intended sequencing in the logic circuit. Such operation can be avoided by utilizing a larger bandwidth for the $2f_1$ "inner" filter 88 than for the $2f_2$ "outer" filter, e.g. twice as large a bandwidth. The noise-induced output energy of the "inner" filter 88 will then be, on the average, twice as great as that from the "outer" filter 92, and will in the presence of such overwhelming ambient noise either hold the logic circuit in state 2 (indicating that the packet is in indoor field region A) or, if it was previously in the state 3 (indicating the packet is in field region B), it will move the logic circuit back to state 2, thus avoiding danger of premature firing.

Figure 5:
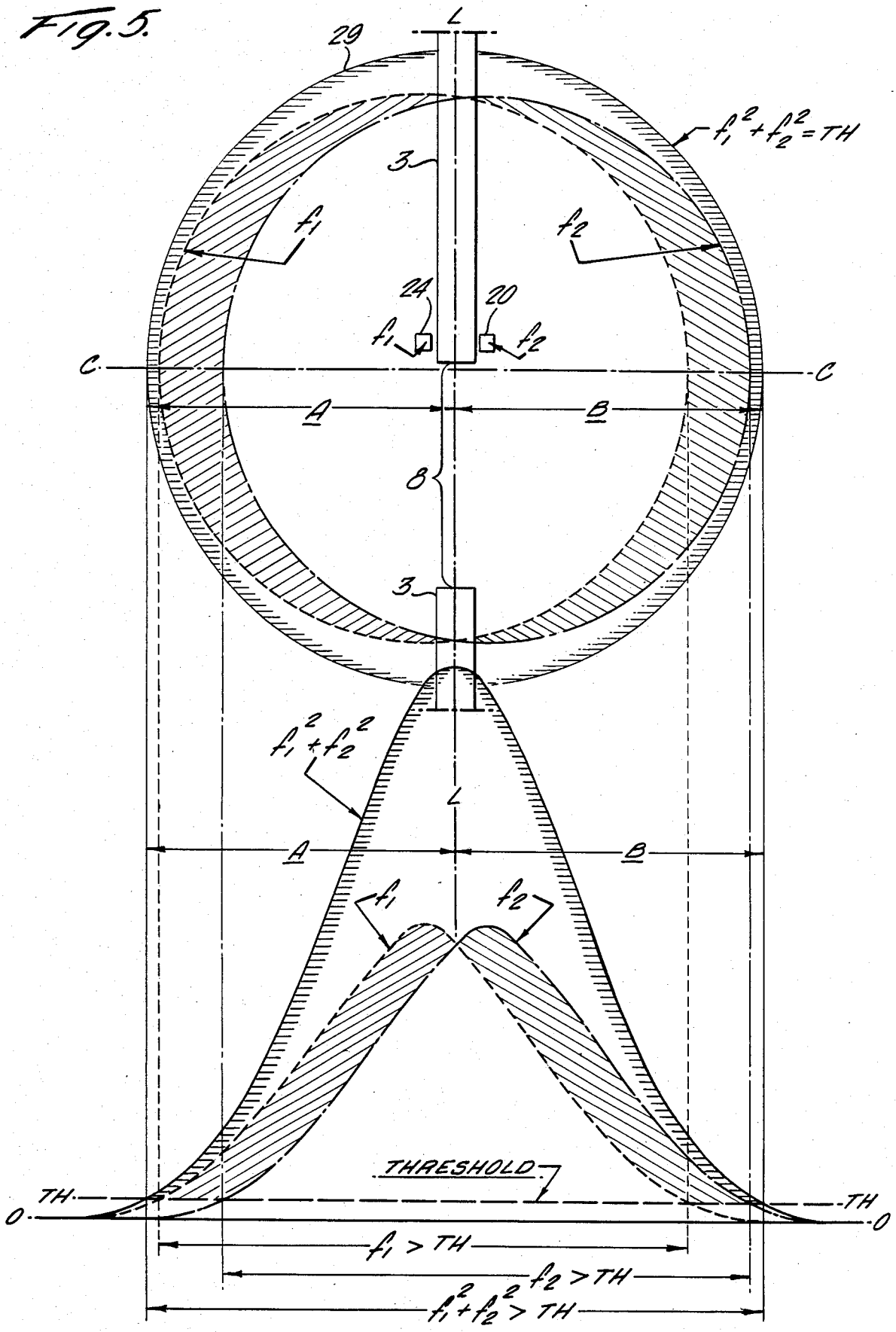
FIG. 5 is a combined field pattern diagram and field strength graph to which reference will be made in explaining the operation of the system.

With regard to the details of the preferred field arrangement and alternative embodiments thereof, reference is first made to the diagrammatic and graphical representation of FIG. 5. Referring to the latter figure, there are represented therein the two transmitters 20 and 24 transmitting magnetic induction fields at frequencies $f_2$ and $f_1$ respectively. The field component at frequency $f_2$ has a solid-line boundary marked $f_2$ at which its scalar magnitude falls below a predetermined threshold level TH, and the field component of frequency $f_1$ has the broken-line boundary marked $f_1$ at which its scalar magnitude falls below the same threshold value TH. The locus at which the sum of the squares of the scalar magnitudes of the field components of frequencies $f_1$ and $f_2$, designated $f_1^2+f_2^2$, exceeds the threshold TH has the boundary 29, also shown in FIG. 1, outside of which the sum of the squares of the two frequency components falls below this same threshold value TH.

The relation of the fields in this example is illustrated by the three graphs at the bottom of FIG. 5, which are idealized plots of the scalar magnitudes of the frequency components at frequency $f_1$ and at frequency $f_2$, as designated, as well as of the sum of the squares of the scalar magnitudes of these two components, designated as $f_1^2+f_2^2$, all plotted as functions of distance along the line C—C in the upper part of FIG. 5. It therefore illustrates idealized variations in scalar magnitude of the two frequency components of the field, and of the sum of their squares, as one moves along the line C—C, from within the protected premises along an egress path to a position outside the protected premises and beyond the boundaries within which any one or the sum of the squares of the two field components exceeds the threshold level TH. It will be understood that the configuration of fields shown is for purposes of explanation of principles only, and does not necessarily represent the exact form of field patterns actually existing in any particular case.

As shown by the graphs, the transmitter 20 for frequency $f_2$ is farther advanced along the path C—C than transmitter 24 for frequency $f_1$, and hence produces a field component the strength of which peaks at a position farther along that line than does the frequency component at $f_1$; the two components are of equal strengths along a line L—L (demarcation line E of FIG. 1) perpendicular to line C—C. Field region B is therefore entirely to the right of the line L—L, since as seen in the lower portion of FIG. 5 the scalar magnitude of the component at $f_2$ is at all times greater than the scalar magnitude at frequency $f_1$ in this region; the converse is true in field region A, to the left of line L—L, where the scalar magnitude of the $f_1$ component always exceeds the scalar magnitude of the $f_2$ component. The sum of the squares of the scalar magnitudes of the two frequency components is of course always larger than the square of the magnitude of either component alone.

Also shown in the graphical representation at the bottom of FIG. 5 is a threshold level TH, together with vertical lines indicating the positions at which the $f_1$, $f_2$ and $f_1^2+f_2^2$ field strengths fall below the latter threshold. The exact shapes of the graphs at the bottom of FIG. 5 have been idealized for simplicity and clarity, but illustrate the principles involved.

It will be understood that in previously known systems only a field with a single discriminable characteristic was created so that no inference would be made by the alarm packet as to its sequence of movements and hence as to its position. Such a scheme was equivalent to having only a field $f_2$, but this suffered from the difficulty, among others, that if a packet were brought from a teller's location into the field $f_2$ and then removed back toward the teller's location, the alarm would be actuated. It will be seen from FIG. 5 that the effect of the present system is to superimpose, upon the threshold-level boundary of the field component of frequency $f_2$ on the inner side of the exit, a stronger field component at a frequency $f_1$. In the outer portion of the fields, i.e. to the right of the line L—L, the strength of the field component at frequency $f_2$ is greater than that at frequency $f_1$. Thus by determining whether the component at frequency $f_2$ is greater or less than the component at frequency $f_1$ when the packet moves from inside to outside the boundary 29, one can determine whether the packet is being removed outward across the external portion of boundary 29 located outside the doorway, or inward across the interior portion of boundary 29 into the protected premises and toward the teller's position.

Accordingly, it will be appreciated that while the field component at frequency $f_1$ in this example suffuses or overlaps the inner boundary of the field A component at frequency $f_2$ and also extends outward of the doorway as shown, it is only important in this example that it cover and extend inward from the inner boundary of the field component at frequency $f_2$. Also, although the boundary 29 for the sum of the squares of the scaler magnitudes of the components of frequencies $f_1$ and $f_2$ is utilized in this preferred embodiment as the criterion of removal of the packet from the field, this is not of fundamental importance, and some other criterion entirely may be used if desired. In the present example, it is preferred to utilize for this purpose the threshold boundary for the sum of the squares of the scalar magnitudes of the field components of frequencies $f_1$ and $f_2$, since this produces a larger signal for the circuits to work with and the $f_2^2$ and $f_1^2$ signals are conveniently available.

More particularly, as shown in the lower-left portion of FIG. 5, the preferred embodiment utilizes the fact that, when the curve marked $f_1^2+f_2^2$ falls below the threshold level TH, the component thereof at frequency $f_1$ is greater than the component thereof at frequency $f_2$, and hence alarm actuation is prevented when the packet is removed inwardly across this boundary; on the other hand, as seen at the right-hand side of the graphs at bottom of FIG. 5, when $f_1^2+f_2^2$ falls below the threshold level on the exterior side of the doorway, the component of frequency $f_2$ is greater than that of $f_1$, and circuitry in the packet which recognizes this then permits actuation of the alarm when the packet is subsequently moved outwardly beyond the boundary 29. However, it is possible instead to use as the characteristic which actuates the firing timer the fact that the scalar magnitude of the field component at frequency $f_1$ falls below a threshold value, or that the scalar magnitude of the field component at $f_2$ falls below a threshold value. This can readily be done by taking the output of one of the detectors 92 or 94 and applying it to the input terminal 103A of comparator 100. In such case the firing timer will be activated when the packet is taken outwardly across the boundary line marked $f_1$ (or $f_2$) in FIG. 5, rather than when it is taken across the $f_1^2+f_2^2$ boundary line 29.

Accordingly, it will be seen that the inner field region A in this example has the identifying characteristic that the scalar magnitude of the field component at $f_1$ is greater than that at $f_2$, and the sum of the squares of the scalar magnitudes of the $f_1$ and $f_2$ components is greater than a preselected threshold level TH. The field region B is characterized by a scalar magnitude of the $f_2$ component greater than that of the $f_1$ component with the sum of the squares of the scalar magnitude of the $f_1$ and $f_2$ components greater than TH. The above-described logic circuitry operates to produce actuation of the firing timer only when the packet circuitry senses that it has been moved from region A into region B and outward from region B across boundary 29 to the exterior.

It will also be appreciated that, from another viewpoint, the system provides a field adjacent the door opening, packet circuitry which senses when the packet is brought into that field (i.e. into a portion of the field having a characteristic in excess of a predetermined threshold level) and when the packet leaves the field (i.e. moves to a position for which the field characteristic is below that threshold level), and a means for producing another identifiable condition which enables the packet to determine whether, when it leaves the field, it is on the outer side of the exit or not. It will be understood that there are types of fields, field components and arrangements and dispositions of fields and detecting circuitries other than those shown in detail which will accomplish this same end purpose.

As shown in FIG. 1, in one preferred embodiment the two transmitters 20 and 24 are placed not on opposite sides of the front wall as suggested in FIG. 5, but on the same inner side, as a matter of practicality. In this event, in some cases it may be desirable to adjust the strengths of the transmitter fields relative to each other to produce curvature of the demarcation line E (and the corresponding demarcation surface), so that although this line passes between the two transmitters, it nevertheless bridges the exit as desired. This may be accomplished by slightly increasing the strength of the transmissions at frequency $f_1$. As an alternative, as shown in FIG. 1, with both transmitters positioned on the inner side of the wall 3 an elongated passageway may be formed by a short pair of passageway walls 298 and 299 on opposite sides of the exitway so that a straight line of demarcation E will bridge the passageway. This is illustrative of the fact that the above-described condition, wherein the inner boundary of the field at frequency $f_2$ is suffused or bounded on its inward side by a field at frequency $f_1$ which is greater than the field of frequency $f_2$, need only be provided in regions which are open to traversal by a person carrying the packet. If certain otherwise-possible paths are blocked-off by partitions or by other means, these criteria need not be met in the blocked-off regions. Thus, in some cases the design of the arrangement may be simplified by choice of a particularly convenient transmitter position and orientation, together with the partitioning-off of areas where otherwise a robber might move back into the protected premises and the alarm be actuated or move outwardly without actuating the alarm.

In one preferred embodiment, the transmitters at frequencies $f_1$ and $f_2$ produce outputs in a pair of transmitter coils each operated at a level of about 100 volts r.m.s. of sinusoidal input; each loop is made up of 140 turns of No. 20 copper wire having a circular shape about 1 foot in diameter, both loops being oriented with their planes parallel to the direction C—C of FIG. 5, i.e. with their coil axes at right angles to the path normally traversed by persons using the door opening. A typical spacing of the coils from each other along the direction C—C is about 15 inches. With this arrangement, a field configuration generally similar to that shown in FIGS. 1 and 5 is obtained.

Another antenna arrangement believed to be advantageous in many installations uses, for each antenna, a loop with one or more turns extending around the top, bottom and sides of the exitway and with the $f_2$ antenna spaced somewhat from the $f_1$ antenna along the direction of egress from the protected premises.

In general, in any particular installation it has been found helpful to set up the arrangement as appears best for the particular application, thus to check the field boundaries by moving an appropriate field measuring instrument (which may be of the general type described in the above-cited copending application) about the premises both inside and outside of the exit, and when the boundaries of the various field regions appear to be satisfactory, testing the operation of an alarm packet under all conceived situations, with a lamp or other indicator substituted for the explosive charge, to be sure that the desired operation will occur.

As pointed out above, to meet the desired objectives of the invention optimally it is necessary to arrange the field configurations so that any egress path from the interior to the exterior of the premises must follow a route which passes first through region A, then through region B, then goes and stays outside the field boundary 29, and furthermore there must be no path which can follow the aforesaid (A to B to outside) sequence while terminating within the premises. If instead there are one or more "sneak paths" which violate these rules, then either a robber may evade the function of the packet or an innocent mover of a packet inside the premises may suffer the consequences of an unintentional activation. Some of the commoner arrangements which can give rise to such sneak paths and how they can readily be avoided will now be described with respect to FIGS. 6–8A.

Figure 6:
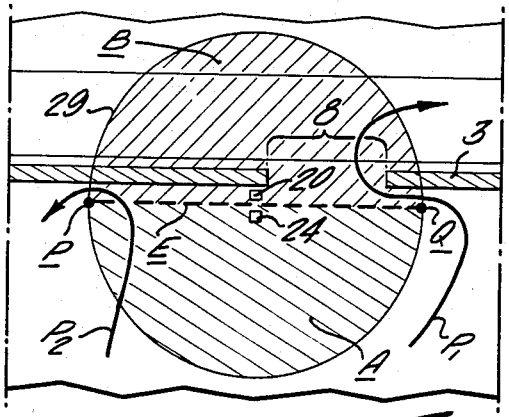
FIGS. 6, 6A, 6B, 7, 7A, 8 and 8A are diagrammatic plan views of the areas near protected exits and illustrating considerations relating to selection of an appropriate field pattern for use in the invention.

FIG. 6 shows the front wall 3 of the protected premises 10 and the exit 8 from the premises, as well as a pair of transmitters 20 and 24 producing the field regions A and B on either side of the field-region demarcation line E. The transmitters are both on the inside of the protected premises and the demarcation line E is straight and extends parallel to the front wall so as to intersect threshold boundary line 29 of the field at the points P and Q. Since P and Q are spaced inwardly of wall 3, it is possible for a robber carrying an alarm packet to traverse the path $P_1$, around the Q end of line E and into region B, without first passing through region A; the path $P_1$ then extends through region B to the exterior, as indicated by the arrow. As shown by the transition diagram of FIG. 4A, when a robber leaves by such a path, the sequence of signals is such that the bistable devices in the packet circuitry will remain in state 1, and the desired alarm actuation will not be achieved.

The other problem with this installation is that it is possible to go through region A, across E into B and then into the interior of the premises by passing by P or Q, near the wall. Such a route, shown as $P_2$, could produce a firing inside the premises.

Figure 6A:
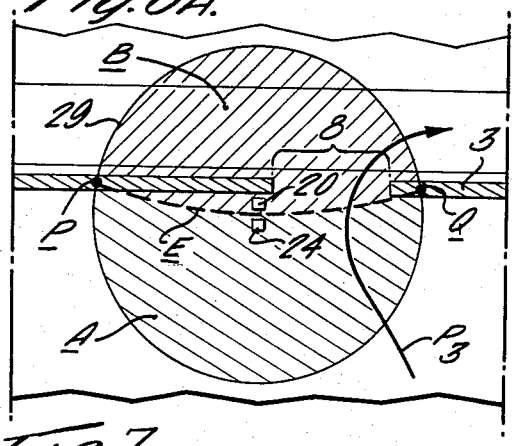

FIG. 6A shows one way of eliminating both of these types of sneak paths. All elements of the figure are the same as in FIG. 6 except that the strength of the field radiated by transmitter 24 has been made somewhat larger than that radiated by transmitter 20, with the result that the demarcation line E is curved as shown, so that the intersection points P and Q lie inside the thickness dimension of front wall 3. In this case, as shown by arrow $P_3$, the robber carrying the packet must exit and leave the area by travelling first through the field region A, then across line E into region B, and then out of region B to a remote position, in that order, which will cause the alarm device to fire after it has been out of field region for a predetermined timed interval. Likewise, no route now exists for a packet to be caused to activate inside the premises.

Figure 6B:
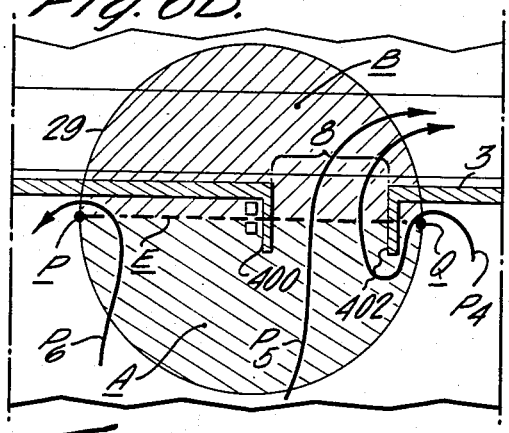

By way of counter example, FIG. 6B shows a means of addressing the problem of the robber escaping without alarm activation but which does not meet the criteria for safety inside the premises. A pair of blocking pedestals 400, 402, each for example extending from the floor to near the ceiling, block off from traversal that portion of the premises which extends from the edges of the exit inwardly across the demarcation line E. The arrow $P_4$ illustrates a path which might be taken by a robber who attempts to follow the path $P_1$ in FIG. 6; after entering the edge of field region B (without going through B) he finds himself blocked by the pedestal or wall 402 and must travel back into region A, before crossing line E into region B and moving thence to the remote exterior. He is therefore compelled to follow a path involving the field sequences which will cause the alarm device to be actuated, as desired. Perhaps more typically, upon seeing the two pedestals the robber will not try to execute the path $P_4$, but instead will travel the path $P_5$, which also involves the desired field sequence and produces the desired firing of the alarm device. However, the interior route $P_6$ extending through A, across E and counterclockwise round P, or the corresponding route around Q, could cause an interior firing.

Figure 7:
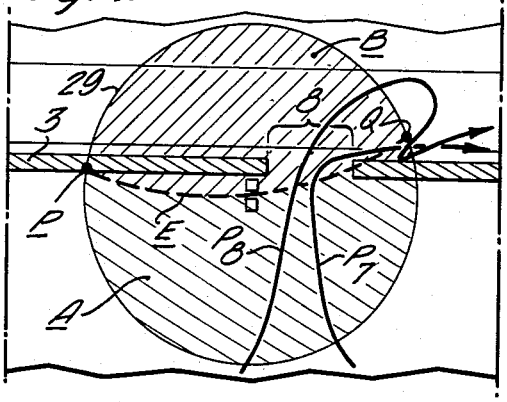
Figure 7A:
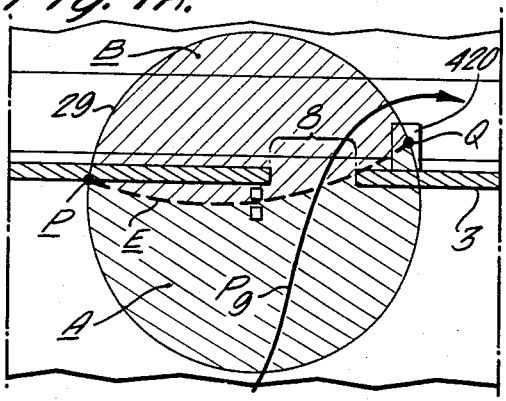

FIG. 7 illustrates another arrangement in which some different types of sneak paths may exist. The elements are the same as in FIG. 6A, except that the exact arrangement of the transmitters and the configuration of the exit is such that the intersection of the curved demarcation line E with the field threshold boundary 29, at point Q, lies outside the protected premises as shown. In such case, it is possible that a robber carrying an alarm packet may traverse the path $P_7$, in which he moves into and through region A and thence to region B, but then recrosses line E outside the exit and finally travels outward across the boundary line 29 from the outdoors portion of region A. As indicated in FIG. 4A, this will leave the bistable devices in the packet in state 1, and the desired actuation of the alarm device will not occur. Another possible sneak path is shown by the arrow $P_8$. Here the robber carries the pack first into region A, then across line E into region B, and next to the exterior of boundary 29, but before the firing timer counts down, he carries it back into the portion of region A exterior to the protected premises and, finally, leaves across boundary 29 from region A. According to FIG. 4A, this leaves the bistable devices in the packet in their state 1 condition, and the firing timer will not be started. One way to overcome this is to adjust the transmitters so that the point Q falls within the front wall as in the FIG. 6A arrangement; lacking this, FIG. 7A shows another way of avoiding such a sneak path, consisting of the use of a partition structure 420 which prevents the robber from entering that portion of field A which extends outside the premises; such partitioning is preferably provided by a useful or decorative structure. He will then be compelled to follow a path like that shown by the arrow $P_9$, which will produce a normal signal sequence and the desired alarm actuation. Because the P and Q intersections are both inaccessible, within the effective boundary wall of the premises, no route exists for an interior firing either.

Figure 8:
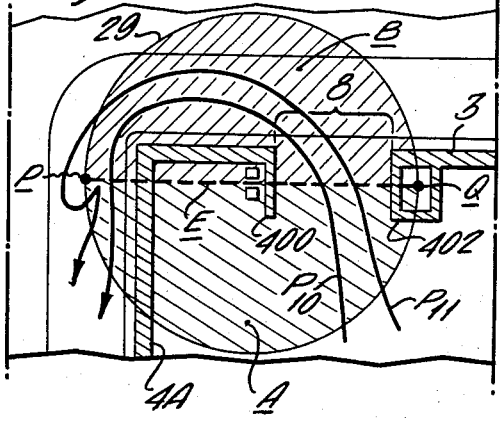
Figure 8A:
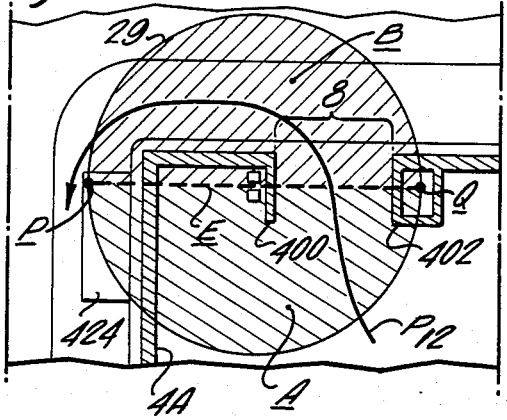

FIG. 8 illustrates another pair of possible sneak paths for the case where the exit 8 is close to the end wall 4A of the protected premises and the transmitter field regions are such that the intersection point P lies outside of wall 4A. In this case, as an example, the robber might follow the path $P_{10}$ extending first through field region A, then across demarcation line E into and through field B and across boundary 29, next recrossing demarcation line E outside wall 4A into field region A again, after which he finally departs region A across boundary 29. Or, he may follow the path $P_{11}$, a normal egress path which would start the firing timer except that, near the end of the path, he reenters the exterior portion of region A and then departs across boundary 29. These two paths, in principle, are similar to those depicted in FIG. 7, in that the trouble arises from the existence of a portion of field region A situated outside of the premises. The same type of solution as in FIG. 7A can be employed, consisting of providing the partition structure 424 of FIG. 8A, which prevents entry into the external portion of field region A and thus prevents either of the paths $P_{10}$ or $P_{11}$ from being taken by the robber; instead, he will be forced to take the path $P_{12}$ of FIG. 8A. Of course, appropriate design of the field patterns can generally avoid the need for such additional partitioning.

The diagrams have displayed all configurations in the form of two dimensional plan views, however in reality the arrangements pertain to three-dimensional space in which the fields have vertical as well as horizontal dimensions.

In essence then, for the system to function to best advantage it is necessary that the demarcation boundary E be a surface which closes the egress from the protected premises, with the further requirement that the intersection of surface E with the boundary surface 29 lie wholly with the boundary walls of the building or premises, so that no paths exist which allow either failure to operate on leaving the premises or activation within the premises.

While a typical preferred application of the invention may utilize the low transmitter frequencies specified above, suitable operation may also be obtained using higher frequencies and so-called far-field transmission, as examples. Thus, in addition to transmitter frequencies in the range of about 10 Hz to 10 KHz for the general type of embodiment described in detail above, one may use signals in the ordinary radio frequency range of about 10 KHz to 1 GHz, or even those normally considered as microwave signals, for example in the range 1 GHz to 30 GHz. Thus, for example, it is possible to direct two parallel and slightly overlapping beams of microwaves across the opening, each beam being at a different frequency from the other or having different coding or modulation, and using appropriate microwave receiving circuitry in the packet to produce substantially the same basic operation as described above; this is by reason of the fact that the arrangement described in detail constitutes, in essence, providing a pair of overlapping but not congruent field components of different characteristics across the door opening, whereby the receiver in the packet can determine the difference between crossing the non-overlapped outer boundary of one of the field regions and crossing the overlapped inner boundary of the same field region.

It is also contemplated that field region A may extend broadly throughout the protected premises, including even the teller's location; this can conveniently be accomplished by applying the $f_1$ transmitter signal to the lighting and other wiring on the premises, in addition to or in place of transmitter 24 at the exit, to produce a wide-spread $f_1$ field which, again, overlaps the inner side of the $f_2$ field and produces a field demarcation line E in the desired position. In this case state 1 of the bistable devices of FIG. 4 persists only for whatever small interval exists between the initial reset pulse and the next clock pulse, but the $f_1$ field in effect, is used to prevent actuation of the firing timer when the packet is anywhere within the portion of the premises flooded by the field component at frequency $f_1$.

FIGS. 9A to 9F illustrate some of the various field configurations usable in accordance with the invention. In these figures lines 300 and 302 represent the opposed confronting surfaces of an exit passage as viewed from above and E is again the demarcation line representing the surface along which the scalar magnitudes of the two field-frequency components are equal.

Figure 9A:
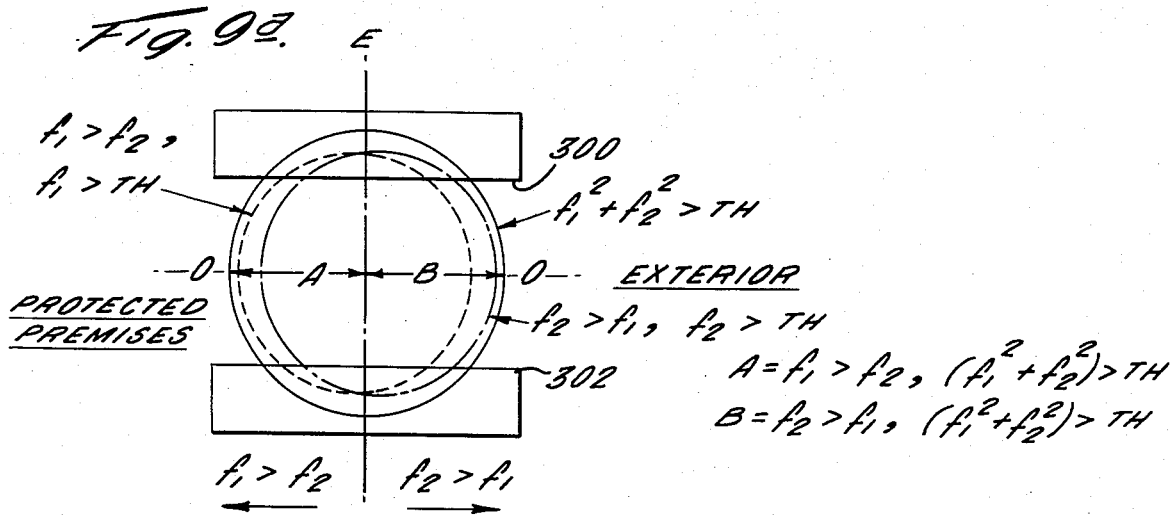
FIGS. 9A through 9F are schematic field diagrams to which reference will be made in describing various alternative field arrangements useful in various forms of the invention.

Referring first to FIG. 9A, field region A is characterized in that within its boundary the scalar magnitude of the $f_1$ field component is greater than that of the $f_2$ component, and the sum of the squares of the scalar magnitudes of the $f_1$ and $f_2$ components is greater than a threshold level TH. The field region B is similarly characterized, with the important exception that the scalar magnitude of the $f_2$ component exceeds that of the $f_1$ component. The extents of the A and B field regions are shown in the figure, the legends and arrows indicating the characteristics of the regions bounded by the lines to which the respective arrows point. The logic circuitry previously described will operate to produce actuation of the firing timer only when the packet has been moved through region A, then through region B, and then beyond region B in the outward direction.

Figure 9B:
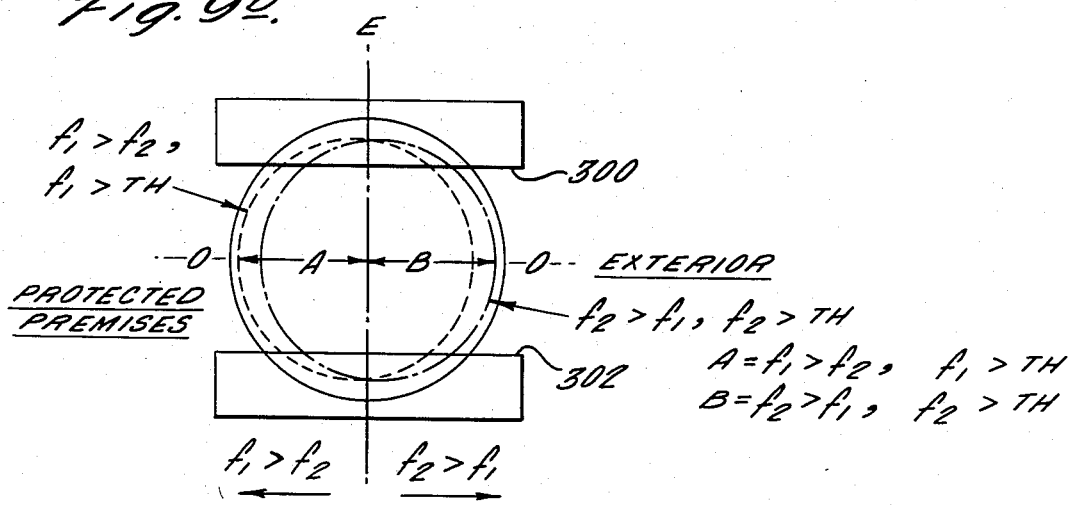

FIG. 9B shows the situation in which the transmitted signals are the same as in FIG. 9A, but as shown the field regions A and B used and defined by the logic system differ from those in FIG. 9A. More particularly, in field region A the scalar magnitude of the $f_1$ field component is greater than a threshold level TH and in field region B the scalar magnitude of the $f_2$ component is greater than TH, with no requirement on the value of the $f_1^2+f_2^2$ scalar magnitude. In this case, the firing timer is actuated when the logic circuitry determines that the scalar magnitude of the $f_2$ component has fallen below TH when the $f_1$ component is not greater than $f_2$ component.

Figure 9C:
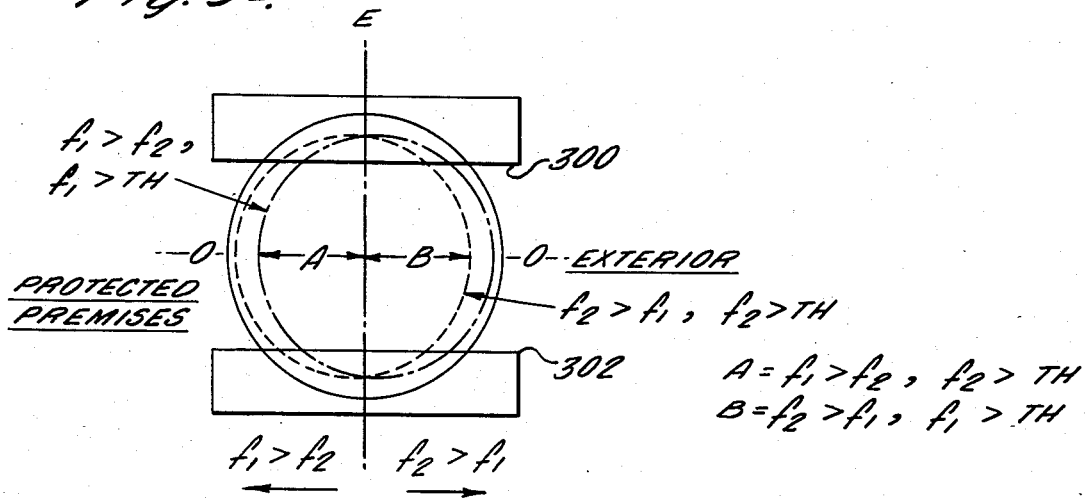

In the arrangement of FIG. 9C, the transmitter fields are the same as in FIGS. 9A and 9B, but as shown the logic circuits identify as field region A that region in which the $f_1$ field component exceeds the $f_2$ field component and the $f_2$ field component is greater than the threshold TH; the logic circuits identify the field region B as that region in which the $f_2$ field component exceeds the $f_1$ field component and the $f_1$ field component is greater than the threshold TH. Again, the firing timer is actuated when the packet leaves the B field region in the outward direction.

Figure 9D:
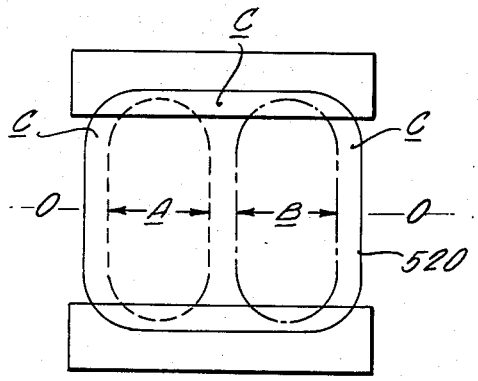

In the arrangement of FIG. 9D, there is an inner field region A in which the $f_1$ field component is greater than a threshold level and an outwardly-spaced field region B in which the $f_2$ field component is greater than the threshold level. Extending through, between, and somewhat beyond the latter two field regions is a field region C in which a third component field of frequency $f_3$ has a scalar magnitude greater than a preselected value. In this case the logic circuitry may be designed to recognize and treat the region marked A as the A field region, and that marked B as the B field region, and will actuate the firing timer when the logic circuitry determines that the packet has reached region A, has subsequently reached region B, and thereafter leaves region B and reaches the exterior region O outside of the three field regions without passing through A on its way from region B to region O. It will be understood that the details of the field-sensing and logic discrimination used may differ in different embodiments. For example, with the field configuration of FIG. 9D, the packet circuitry may actuate the firing timer only when it detects that the packet has moved outwardly through a C field, an A field, a C field, a B field, a C field, and finally outside the C field to the exterior region O, in that order. This sequence includes within it the basic field sequence A-B-O, plus the other indicated field-sensing steps which may be useful or desirable in some applications of the invention.

Figure 9E:
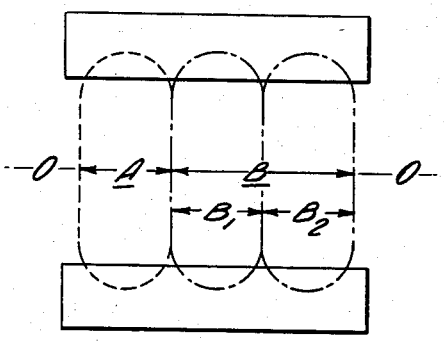

Referring to the field arrangement of FIG. 9E, two contiguous field regions A and B are shown, with B divided into two sub-regions $B_1$ and $B_2$. Each of A, $B_1$ and $B_2$ has its own identifying field characteristic. Accordingly, the field-sensing and logic circuitry in such case senses when regions A and B (i.e. $B_1$ and $B_2$) have been traversed outwardly by the packet and actuates the firing timer when the packet thereafter leaves region B other than to return to region A.

Figure 9F:
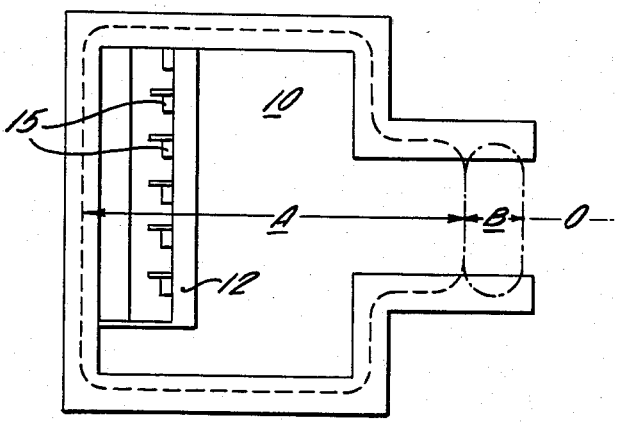

FIG. 9F illustrates a field configuration like that of FIGS. 1 and 5, except that the inner field region A has been extended to include all of the interior of the protected premises including the teller's location such as 14. In this case the robber and packet normally starts out in field region A, travels through that region into region B at the exit, and thence out of B to the exterior O, with the packet circuitry sensing this sequence and actuating the firing timer when the packet leaves region B for the exterior O. Whenever the packet is in the protected premises, it cannot cause actuation of the timer since these premises are suffused with the A field, which does not permit such actuation.

It will be understood that the field regions shown by way of example in FIGS. 9A–9F need not be characterized by different frequencies, but may use instead any convenient and detectable identifying characteristic such as modulation, sonic energy, etc. It will also be understood that there are many other combinations of field regions and field characteristics which can be used in various embodiments of the invention. In each case however, there must be at least two mutually distinguishable field regions at different locations along the path of the packet, in order to permit the packet circuitry to determine the direction of travel of the packet, and where more than two such regions are provided and detected they should not be in a symmetrical arrangement for which the packet would detect the same sequence when moved in either the outward or the inward direction.

Accordingly, while the invention has been shown and described with particular reference to specific embodiments in the interests of complete clarity, it will be understood that it may be embodied in a variety of forms diverse from those specifically shown and described without departing from the spirit and scope of the invention as defined by the appended claims.

TABLE I

| System State | | | | AP Inputs | | BP Inputs | | Result of Clock | |
|---|---|---|---|---|---|---|---|---|---|
| SP | BG | AP | BP | JA | KA | JB | KB | AP | BP |
| 0 | 0 | 0 | 0 | 0 | 1 | 0 | 0 | 0 | 0 |
| 0 | 0 | 0 | 1 | 1 | 0 | 0 | 0 | 1 | 1 |
| 0 | 0 | 1 | 0 | 0 | 1 | 0 | 0 | 0 | 0 |
| 0 | 0 | 1 | 1 | 1 | 0 | 0 | 0 | 1 | 1 |
| 0 | 1 | 0 | 0 | 0 | 1 | 0 | 0 | 0 | 0 |
| 0 | 1 | 0 | 1 | 1 | 0 | 0 | 0 | 1 | 1 |
| 0 | 1 | 1 | 0 | 0 | 1 | 0 | 0 | 0 | 0 |
| 0 | 1 | 1 | 1 | 1 | 0 | 0 | 0 | 1 | 1 |
| 1 | 0 | 0 | 0 | 1 | 0 | 0 | 1 | 1 | 0 |
| 1 | 0 | 0 | 1 | 1 | 0 | 0 | 1 | 1 | 0 |
| 1 | 0 | 1 | 0 | 1 | 0 | 0 | 1 | 1 | 0 |
| 1 | 0 | 1 | 1 | 1 | 0 | 0 | 1 | 1 | 0 |
| 1 | 1 | 0 | 0 | 0 | 1 | 0 | 0 | 0 | 0 |
| 1 | 1 | 0 | 1 | 0 | 1 | 0 | 0 | 0 | 1 |
| 1 | 1 | 1 | 0 | 0 | 1 | 1 | 0 | 0 | 1 |
| 1 | 1 | 1 | 1 | 0 | 1 | 1 | 0 | 0 | 1 |

What is claimed is:

1. A system for producing alarm-actuating signals in a packet when it is moved in a predetermined direction along a path extending from a first position on one side of a check point to a second position on the other side of said check point, comprising:

field-generating means for producing, adjacent said check-point and along said path, first and second mutually-exclusive field regions containing fields of detectable magnitudes and respectively different field characteristics, with the beginning of said second field region positioned further along said path in said predetermined direction than said first field region, and for also producing an additional detectable field condition, different from the field characteristics of said first and second regions, at a predetermined position further along said path than said beginning of said second field region but not as far along said path as said second position;

circuit means in said packet for producing field-indicating signals indicative of whether said packet is in said first field region, in said second field region, or at said predetermined position where said additional detectable field condition exists; and logic means in said packet responsive to said field-indicating signals for producing alarm-actuating signals in said packet only when said packet has been moved along said path from said first field region through said second field region to said predetermined position.

2. A system for activating an alarm packet to enable it to produce an alarm after it has been carried along an egress path from a teller's position within protected premises, through an exit to the exterior of the protected premises, and away from said exit, comprising:

(a) field-generating means for generating within said premises a composite field comprising a field region A which extends across said egress path and which comprises a first frequency component of frequency $f_1$ and a second frequency component of frequency $f_2$, said first frequency component of frequency $f_1$ having a scalar magnitude no less than that of said second frequency component of frequency $f_2$ in said field region A, said composite field also comprising a field region B which extends across said egress path from the exterior side of said region A, said region B comprising a first frequency component of frequency $f_1$ and a second frequency component of frequency $f_2$, said second frequency component in field region B having a scalar magnitude greater than that of said first frequency component in said field region B;

(b) receiver means in said packet comprising first means responsive to said composite field for producing first signals indicative of whether or not said second frequency component at frequency $f_2$ at said packet has a scalar magnitude greater than that of said first frequency component at said packet, thereby to indicate whether said packet is in field region A or field region B;

(c) second means in said receiver means responsive to said composite field for producing second signals indicative of whether or not the sum of the squares of the scalar magnitudes of said first and second frequency components is at least as great as a predetermined threshold value, thereby to indicate whether said packet is within a predetermined boundary circumscribing said exit; and (d) logic means responsive to said first and second signals for producing an alarm-actuating output signal only after said first and second signals indicate that the packet has been taken directly from field region A to field region B and from field region B outwardly across said boundary, in that order.

3. The system of claim 2, wherein said frequencies $f_1$ and $f_2$ are in the sonic frequency band, and said field-generating means comprises a first transmitting antenna supplied with signals of said frequency $f_1$ and a second transmitting antenna supplied with signals of said frequency $f_2$, said second transmitting antenna being positioned toward the exterior of said premises with respect to said first antenna.

4. In a system for automatically actuating alarm means in an alarm packet in response to removal of said packet from the interior of protected premises by way of an exit therefrom, comprising field-generating means for producing a localized alarm-packet actuating field of at least a predetermined magnitude extending across said exit so that said alarm packet must pass through said field during its movement through and away from said exit, and wherein said alarm packet comprises means responsive to removal of said packet from said field to enable actuation of alarm means in said packet, the improvement wherein:

said field-generating means comprises means for establishing in said actuating field a first localized field region extending across said exit and having a first characteristic to which said alarm packet is responsive when in said first field region, and for establishing in said actuating field a second localized field region extending across said exit entirely on the side of said first field region toward the exterior of said premises and having a second characteristic, different from said first characteristic, to which said alarm packet is responsive when in said second field region;

said alarm packet comprises field-sensing means for producing signals indicating that said alarm-actuating field at said packet is of at least said predetermined magnitude, means responsive to said signals and to said second characteristic of said second field region for enabling the initiation of said actuation sequence of said alarm packet when said packet is removed from said second field region into a region other than said first field region, and means responsive to said signals and to said first characteristic of said first field region for preventing initiation of said actuation sequence of said alarm packet when said alarm packet is in said first field region;

and wherein said first and second field regions both contain electromagnetic field components of frequencies $f_1$ and $f_2$, wherein said first characteristic of said first field region is that said field of frequency $f_l$ therein has at least a certain minimum strength, and wherein said second characteristic of said second field region is that said field of frequency $f_2$ therein has at least a certain minimum strength.

5. The system of claim 4, wherein said minimum strength of said field of frequency $f_1$ in said first field region is equal to the strength of said field of frequency $f_2$ at the same location in said first field region, and wherein said minimum value of said field of frequency $f_2$ in said second field region is equal to the strength of said field of frequency $f_1$ at the same location in said second field region.

6. The system of claim 5, wherein said alarm packet comprises means for sensing the relative scalar magnitudes of said fields of frequencies $f_1$ and $f_2$ at said packet to determine whether said packet is in said first or in said second field region.

7. The system of claim 6, wherein said alarm packet comprises means for preventing actuation of said alarm packet while it is at a location where the scalar magnitude of said field of frequency $f_1$ is at least as great as the scalar magnitude of said field of frequency $f_2$.

8. A system for activating an alarm actuating means in an alarm packet when the packet is moved along an egress path and through an exitway from protected premises, comprising:

composite-field generating means for producing a composite field extending across said egress path so that when an alarm packet is carried outwardly along said egress path and through said exitway it passes through said composite field; and an alarm packet responsive to said composite field for actuating an alarm means therein when said alarm packet has been moved along said egress path and through said exitway;

wherein:

said composite field contains a first field region extending across said egress path and a second field region contiguous to, and extending outwardly from, the outer side of said first field region and across said egress path;

said first field region is characterized by a first identifying field characteristic detectable by said alarm packet;

said second field region is characterized by a second identifying field characteristic different from said first characteristic and detectable by said alarm packet;

said composite field exhibits a third identifying field characteristic outside said first and second field regions and within a predetermined boundary;

said alarm packet comprises first means for detecting the existence of said first identifying field characteristic at said alarm packet and for producing a first signal representative thereof, second means for detecting the existence of said second identifying field characteristic at said alarm packet and for producing a second signal representative thereof, third means for detecting the existence of said third identifying field characteristic at said alarm packet and for producing a third signal representative thereof, and logic means responsive to said first, second and thrid signals for activating said alarm actuating means whenever said alarm packet is positioned in said first field region, then moved therefrom directly into said second field region, and then removed outwardly across said boundary of said composite field, in that order;

and wherein said composite field has a first frequency component at frequency $f_1$ and a second frequency component at frequency $f_2$, said first identifying characteristic is that the scalar magnitude of said first frequency component is not less than the scalar magnitude of said second frequency component, said second identifying characteristic is that the scalar magnitude of said second frequency component is greater than that of said first frequency component, and said third identifying characteristic is that the sum of the squares of the scalar magnitudes of said first and second frequency components is greater than a predetermined threshold value.

9. Apparatus for activating an alarm system in a packet when said packet is moved from the interior of protected premises along an egress path extending through an exit way to the exterior, comprising:

means for generating a first field region having a first identifying field characteristic, a second field region having a second identifying field characteristic, and a third field region exhibiting a third identifying field characteristic and having a closed outer boundary surrounding said exit area, said first and second field regions being mutually-exclusive and contiguous to each other within said third field region, the surface of demarcation between the contiguous portions of said first and second field regions extending across and bridging said exit area;

first means in said packet for sensing which of said first, second and third field characteristics are present at the packet, to produce first signals indicative of which of said field regions are being traversed by said packet; and second means in said packet responsive to said first signals for producing second signals to activate said alarm system only when said packet has been moved along said egress path in said first field region, then through said surface of demarcation, next through said second field region, and then across the outer boundary of said third field region, in that order.

10. The apparatus of claim 9, wherein the intersections of said surface of demarcation with said boundary of said third field region are located so that the packet cannot be moved from said first field region to said second field region and then from said second region to the exterior without crossing through said surface.

11. The apparatus of claim 10, wherein the portions of said intersection at levels accessible to a person traversing said egress path are located within the walls of said premises or in structures extending from said walls.

12. In a system for automatically actuating alarm means in an alarm packet when said packet is moved from the interior of protected premises along an egress path extending through an exit way to the exterior, the improvement comprising:

means for establishing an inner region which is of finite extent and disposed completely or substantially completely across said egress path, and which exhibits a first identifying field characteristic;

means for establishing an outer region which is also of finite extent and disposed completely or substantially completely across said egress path, and which exhibits a second identifying field characteristic which is different from said first identifying field characteristic;

said inner and outer regions being mutually exclusive, said inner and outer regions being situated so that said packet moves from said inner region through said outer region to the exterior as it is taken from the interior to the exterior of said protected premises;

means for establishing a composite region which encompasses said inner and outer regions and which has a third identifying characteristic;

first means in said packet for sensing which of said first, second and third identifying characteristics is present in said packet and to produce a first signal indicative of whether said packet is in said inner region, said outer region or neither, and whether said packet is inside or outside said composite region; and second means in said packet responsive to said first signal to activate said alarm only when said packet has been moved along an egress path from said inner region to said outer region, and subsequently from said outer region to a position outside said outer region and outside said composite region without returning to said inner region on its travel from said outer region to said position outside said composite region.

* * * * *